US008720068B2

(12) United States Patent
Landwehr

(10) Patent No.: US 8,720,068 B2
(45) Date of Patent: May 13, 2014

(54) HAND CUTTER WITH BLADE GUARD

(75) Inventor: Thomas Jay Landwehr, Green Bay, WI (US)

(73) Assignee: Ritesafety Products International, LLC, Green Bay, WI (US)

( * ) Notice: Subject to any disclaimer, the term of this patent is extended or adjusted under 35 U.S.C. 154(b) by 177 days.

(21) Appl. No.: 13/353,433

(22) Filed: Jan. 19, 2012

(65) Prior Publication Data

US 2013/0185943 A1 Jul. 25, 2013

(51) Int. Cl.
*B67B 7/00* (2006.01)

(52) U.S. Cl.
USPC ..... 30/2; 30/162; 30/286

(58) Field of Classification Search
USPC ..... 30/2, 286, 294, 162
See application file for complete search history.

(56) References Cited

U.S. PATENT DOCUMENTS

| | | | | |
|---|---|---|---|---|
| 5,241,750 | A * | 9/1993 | Chomiak | 30/2 |
| 5,697,157 | A * | 12/1997 | Votolato | 30/2 |
| 6,560,873 | B1 * | 5/2003 | Ortner et al. | 30/2 |
| 6,578,266 | B2 * | 6/2003 | Chomiak | 30/2 |
| 7,356,928 | B2 * | 4/2008 | Votolato | 30/2 |
| 7,886,443 | B2 * | 2/2011 | Votolato | 30/151 |
| 8,099,868 | B1 * | 1/2012 | Votolato | 30/2 |
| 8,122,605 | B2 * | 2/2012 | Votolato | 30/2 |
| 8,127,452 | B2 * | 3/2012 | Garavaglia et al. | 30/2 |
| 8,234,790 | B2 * | 8/2012 | Schmidt et al. | 30/151 |
| 2013/0061478 | A1 * | 3/2013 | Lutgen et al. | 30/160 |

* cited by examiner

*Primary Examiner* — Omar Flores Sanchez

(57) ABSTRACT

A hand cutter with a blade guard providing the highest possible protection from accidental cutting. The blade guard can be effortlessly activated from the locked position by a trigger, which is achieved by closing the hand around the cutter handle. The released blade guard remains in the released state until the blade has been put to use by cutting the object, when the blade guard release is removed so that the blade guard is automatically relocked as soon as the blade guard returns to the initial protected position.

11 Claims, 3 Drawing Sheets

HAND CUTTER WITH BLADE GUARD

FIELD OF THE INVENTION

The present invention relates to a hand cutter with blade guard according to the preamble to Patent-claim 1.

BACKGROUND OF THE INVENTION

Hand cutters with blade guards for protection are well known and have been present in the market for many years. The need for cutting tools with the highest possible protection for the user is increasing in today's market, where many goods are shipped throughout the world. Solutions range from low cost devices with integrated blades to more sophisticated hand cutters with replaceable blades. Several means are known for providing safe handling of the cutters, both for when these are in use, as well as when they are not in use. One common solution is to stow the cutting blade within the handle of the cutting tool when it is not in use. The blade is extended out of the handle for cutting before its use and can be stowed back in the handle after its use. Another known solution is the addition of a protective guard, which can be placed over the blade, when the cutting tool is not in use.

German patent DE 3 116 354 and U.S. Pat. No. 4,086,698 show solutions with a longitudinal blade guard. This blade guard is located on the side of the cutting edge of the blade. It is permanently forced to the extended position by a spring, thus protecting the blade from accidentally cutting. This solution is designed to protect the user as soon as the blade leaves the object to be cut. However it has the disadvantage, that depending on the angle at which the blade is placed on the object, the blade guard will get jammed and must be manually pushed to the retracted position to allow cutting the object.

U.S. Pat. No. 5,697,157 shows another solution, where a guard is attached to the handle, which can be rotated between the extended position, where the blade is covered by the guard, and the retracted position, where the blade can be used for cutting. While this solution provides some protection, it does not protect from accidental use of the blade, nor does it provide protection, when the blade is being used and the user slips from the object being cut. German Patent DE 3 540 026, which has a similar type of blade guard, has an elastic mechanism permanently forcing the guard back to the extended position. It also shows a mechanism that can be used for locking the blade guard when the cutting tool is not in use. However this blade lock must be activated separately after the cutting process and again does not provide protection when the user accidentally slips from the object being cut.

Recent developments have combined the automatic protection from accidental use of the blade as shown in German Patent DE 3 116 354 and U.S. Pat. No. 4,086,698 with an automatic relocking of the blade guard as soon as the cutter is no longer in use. This is done by providing a means permanently forcing the blade guard to the position, where the user is protected, together with an automatic locking of the blade guard in the protected position, triggered by the use of the cutter. In U.S. Pat. Nos. 6,578,266 and 6,560,873 the automatic locking is triggered by a movement of the blade guard. The blade guard can be unlocked by actively pressing a button and the relocking mechanism is activated as soon as the blade guard is moved from the protected position through a contact of the blade guard with the object to be cut. The presented trigger mechanisms in these inventions require use of the thumb, which leads to a quick tiring of the user, if there are many objects that need to be cut. Also the automatic relocking can be easily triggered, when the blade guard accidentally touches the object without actually cutting it, so that it needs to be unlocked again before a cut can be made. This can lead to additional tiring of the user.

SUMMARY OF THE INVENTION

The main object of the present invention is to provide an improved, easy to use and safe hand cutter with a blade guard providing the highest possible protection from accidental cutting. The blade guard can be released from the protected position by a trigger, which is easily activated. The released blade guard remains in the released state until the blade has been put to use. As soon as the object has been cut the blade guard release is removed so that the blade guard is automatically relocked as soon as the blade guard returns to the initial position, in which the blade is protected.

Another object of the invention is to provide an improvement to the trigger mechanism, allowing an effortless activation of the blade guard release from the locked position, so that the user does not easily get tired, when doing multiple cuts. This is achieved by providing a means to activate the trigger by closing the hand around the cutter handle, instead of requiring the use of a thumb or finger to push or slide an activation button.

It is a further object of the invention to provide a means for easy and safe transportation of the cutter. This is achieved by providing a loop at the rear end of the cutter housing, which can be attached to a keychain or lanyard and a mechanism for permanently locking the blade guard in the protected position in order to prevent accidentally releasing the blade guard.

A final object of the invention is to provide a simple to use means for limiting the cutting depth of the blade by limiting the movement range of the blade guard.

DETAILED DESCRIPTION OF THE INVENTION

Figure 1:
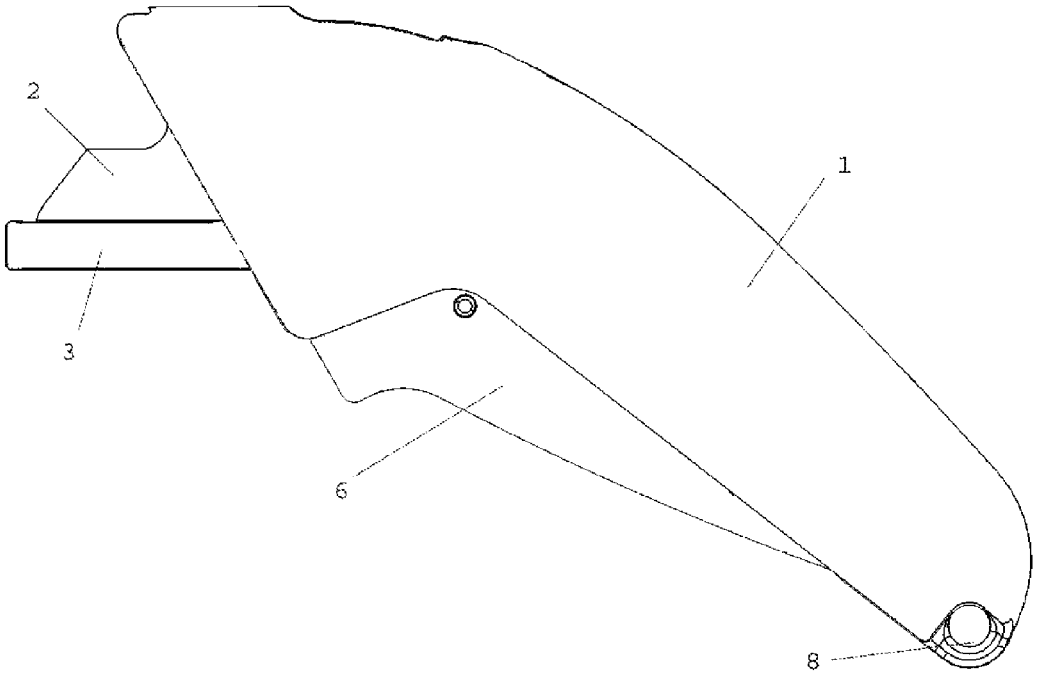
FIG. 1 is a side view of the hand cutter

FIG. 1 is a side view of the outside of the hand cutter. The cutter consists of a compact housing 1, which has a trigger button 6 extending downwards on the lower part of the housing. At the front end of the cutter the blade 2 is protected by a blade guard 3. At the rear end the cutter has a loop 8, which can be used for attaching the cutter to a keychain or lanyard, which can be attached to a belt or carried around the neck. This allows the cutter to be carried around easily without the use of the hands, and without the need to place it in a pocket and removing it from the pocket before another use. It therefore allows the use of both hands for moving the objects, which are being cut.

The housing 1 is formed such that it fits the users hand nicely and the trigger button 6 can be easily pushed by closing the hand or forming a first, without much effort or the need to use the thumb. Since no sliding motion is required and gripping the handle is the way the cutter should be held for cutting in any case, this allows multiple activations of the trigger without tiring the users thumb or fingers.

Figure 2:
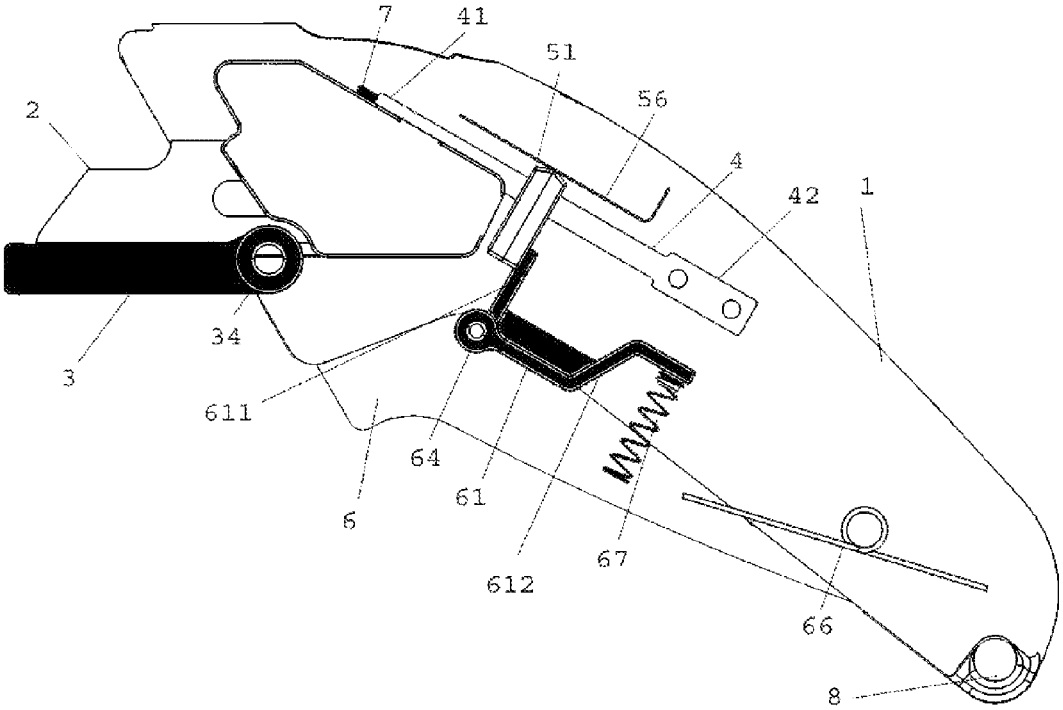
FIG. 2 is an internal side view of the hand cutter, from the left hand side.

In FIG. 2 the preferred embodiment is shown without the housing cover. It shows the trigger ramp 61, which is connected to the trigger button 6 in a way that allows the trigger ramp to rotate around the trigger pivot 64. The torsion spring 66 and the button spring 67 complete the trigger assembly. The torsion spring 66 is connected to the housing 1 and permanently forces the trigger button 6 downward, so that it moves to the relaxed position as soon as the grip on the cutter is released. The button spring 67 connects the trigger button 6 to the rear arm 612 of the trigger ramp 61. It has a fixed length and executes a force attempting to keep the distance d between the trigger button 6 and the trigger ramp 61 constant. As soon as this distance d is either extended or reduced the button spring 67 executes a force in the opposite direction. The front arm 611 of the trigger ramp is vertically oriented and connects the trigger assembly to the release assembly.

Figure 4:
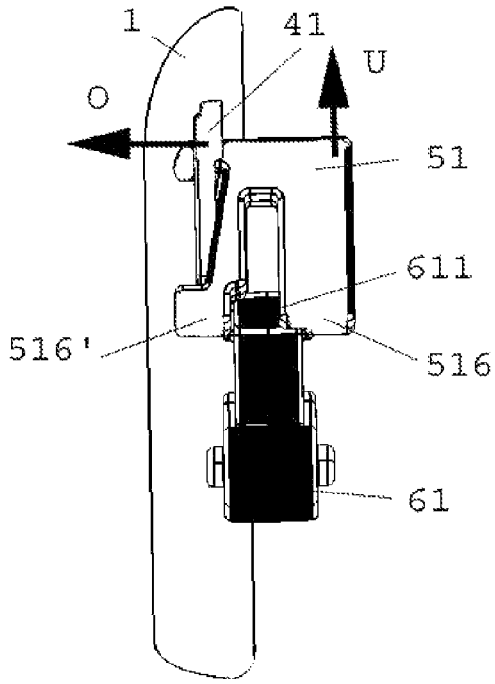
FIG. 4 is an internal view from the front of the cutter.

The release assembly consists of the release piece 51 and a flat spring 56. The flat spring 56 is connected to the housing 1 and permanently creates a force pushing the release piece 51 downwards. The release piece 51 basically has the form of an arch. In FIG. 4 the release piece 51 is shown from the front of the cutter. In a further embodiment the middle opening of the release piece 51 is narrow in the upper part and has a widening step on both sides at the bottom part 516, 516'. The top of the front arm of the trigger ramp 611 is wider that the narrow part of the opening of the release piece, but fits in the wider lower part between the bottom end 516, 516' of the release piece 51. If the trigger ramp 61 is pushed upwards, the top of the front arm of the trigger ramp 611 pushes against the bottom part 516, 516' of the release piece 51 and forces it upwards in direction U against the force of the flat spring 56.

On one side the release piece 51 is slanted so that it becomes thicker towards the bottom. This increasing thickness creates an outwards force O as the release piece 51 is moved upwards, thus moving the front part of the lock piece 41 outwards towards the side of the housing 1. The lock piece 4 is fixed to the housing 1 at the rear end 42 (FIG. 3) and is made of a material that is slightly elastic. This allows the front part of the lock piece 4 to be moved outwards, while at the same time creating a force pushing it back towards the center of the cutter. The outward movement created by the slanted release piece 51 moves the front part of the lock piece 41 out of the path of the rear arm of the blade guard 32, which releases the blade guard 3, so that it can move freely.

Figure 3:
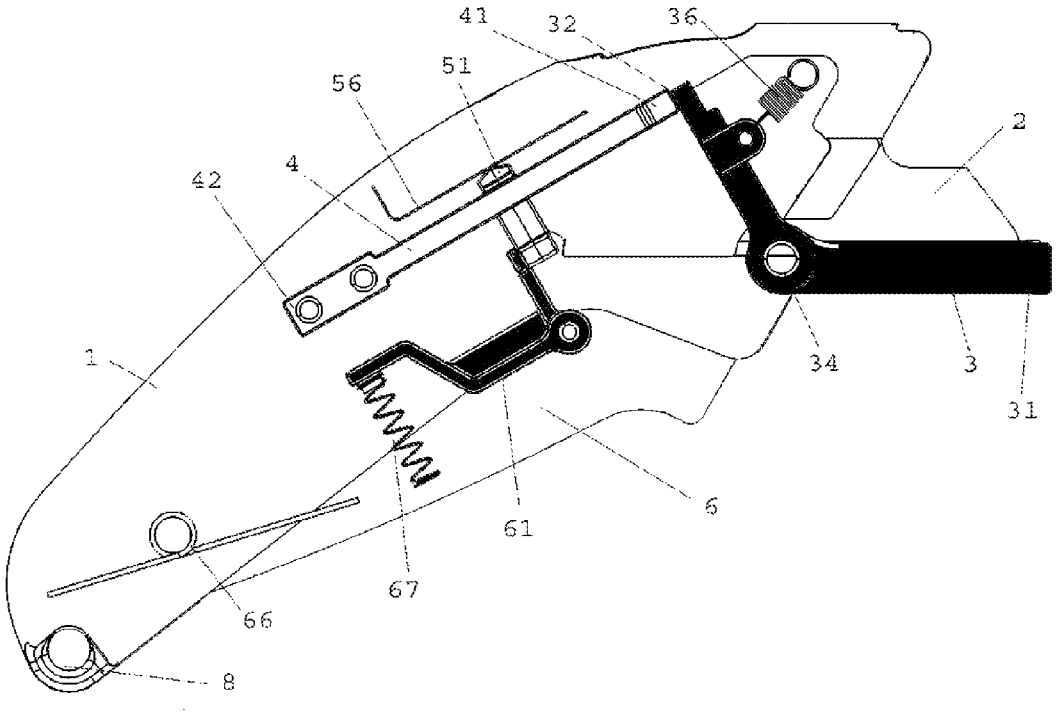
FIG. 3 is an internal side view of the hand cutter, from the right hand side.

As can be seen in FIG. 3 the rear arm 32 of the blade guard 3 is in contact with the front part of the lock piece 41. If the lock piece 4 is in the regular position it prevents the rear arm of the blade guard 32 from moving to the rear of the cutter. This locks the blade guard 3 by preventing the front arm 31 from moving upwards and exposing the blade 2. As soon as the front part of the lock piece 41 is displaced outwards, the rear arm 32 of the blade guard is free to move towards the rear of the cutter so that a force applied to the front arm of the blade guard 31 will result in the blade guard rotating around pivot point 34. Such a force on the blade guard 3 is created as soon as the cutter is placed on the object to be cut and rotates the blade guard 3 and exposes the blade to allow cutting of the object.

To ensure that the blade guard 3 returns to its original position, covering the blade 2, a guard spring 36 is attached to the rear arm of the blade guard 32 and the housing in the front part. The guard spring 36 executes a permanent force rotating the blade guard 3 back to the closed position, so that the blade 2 is never exposed without actually being in contact with the object to be cut.

A further improvement to the preferred embodiment includes a movable knob on one side of the housing in the area of the rotation of the front arm of the blade guard 31. The knob extends on the inside of the housing, so that its end blocks the front arm of the blade guard 31 from rotating further, thus limiting the cutting depth. This knob can be further be placed in a groove so that it can be adjusted to the desired maximum cutting depth either between preset positions or by a screwing mechanism fixing it at the desired location in the groove.

Figure 5:
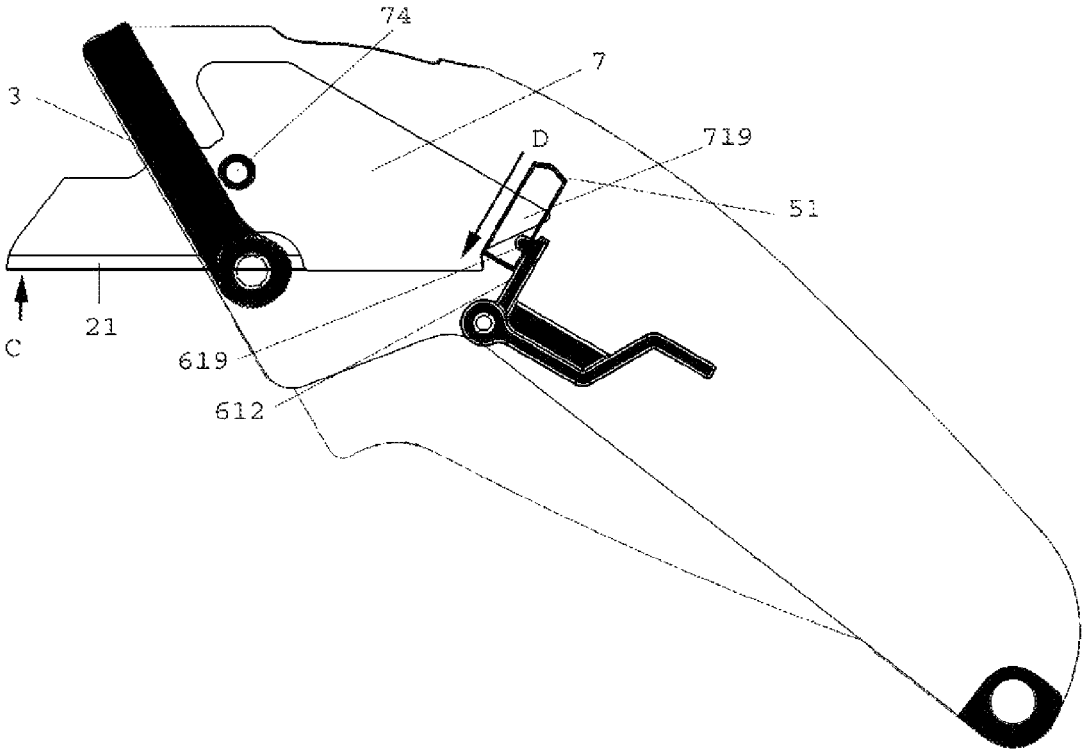
FIG. 5 shows the blade holder and the trigger ramp, while the cutter is in use

As can be seen from FIG. 5 the blade holder 7 is connected to the housing 1 at a pivot point 74. The blade 2 is placed in the blade holder 7 in a way that any movement of the blade 2 is automatically transferred to the blade holder 7, and vice versa.

Assuming that the blade guard 3 has been released as described above and the cutter is placed on the object to be cut, the front arm of the blade guard 31 will be rotated upwards as the cutting edge of the blade 21 comes into contact with the object. When the cutter is pressed into the object to be cut a force C is executed to the cutting edge 21 forcing the blade holder 7 to rotate slightly around the pivot point 74 as soon as the first cut is made. At the other end of the blade holder 7 there is an extension of the blade holder 719, which is moved slightly to the rear and downwards D when the blade holder 7 rotates. In the preferred embodiment the extension 719 fits between the two legs of the arch of the release piece 51 and extends to a point where it is in contact with the rear arm of the trigger ramp 612. To allow a better contact between the extension 719 and the rear arm of the trigger ramp 612 a bump 619 can be provided on the back side of the rear arm of the trigger ramp 612 as can be seen in FIG. 5. As the extension 719 is moved downwards by the pivoting blade holder 7 the rear arm of the trigger ramp 612 is forced rearwards. With this movement it is pushed out of the contact area with the bottom part of the release piece 516, 516'. The release piece 51 is then free to move downwards and will be forced back to its original position by the flat spring 56. This allows the front end of the lock piece 41 to return back to the original position. Since the rear arm of the blade guard 32 is rotated to the back during the process of cutting an object, the blade guard 3 is not locked by the front end of the lock piece 41 until the rear arm of the blade guard 32 is rotated back to the front of the lock piece 41. Due to the elasticity of the lock piece 4, the rear arm of the blade guard 32 can pass the lock piece by temporarily moving the front of the lock piece 41 to the outside.

As soon as the cutting process is done and the cutter is removed from the object, the blade guard 3 is rotated back to its original position protecting the blade, where the rear arm of the blade guard 32 is again beyond the front end of the lock piece 41 as described above. With the lock piece 4 back to the original locked position the blade guard 3 cannot be rotated again due to the presence of the front end of the lock piece 41 behind the rear arm of the blade guard 32 until the trigger button 6 is activated again, releasing the blade guard 3.

In a particular embodiment the cutter includes a mechanism preventing the user from accidentally unlocking the blade guard 3. This provides additional safety when the cutter is carried around while not being in use. In the rear part of the housing 1 a trigger lock is introduced, which can be moved longitudinally between two positions: a locked position, when the trigger lock is in the front position and an unlocked position, when it is in the back position. The trigger lock has a knob, which extends towards the outside and is guided in a longitudinal opening on the side of the housing. This knob can be manually moved between the locked and the unlocked position. On the inside of the housing 1 the trigger lock extends in such a way that the extension is located directly above the rear arm of the trigger ramp 612, if the trigger lock is in the locked position. If the trigger button 6 is pressed, while the trigger lock is in the locked position the rear arm of the trigger ramp 612 cannot move upwards. Therefore the trigger ramp 61 is rotated and the front arm 611 is moved towards the back, so that it does not push the release piece upwards. In this way an accidental unlocking of the blade guard is prevented if the trigger lock is placed in the locked position.

The invention claimed is:

1. A hand cutter comprising
a housing
a blade
mounted detachably in the housing,
having a cutting edge at the front of the knife,
a blade guard assembly
mounted pivotally in the housing,
said blade guard assembly comprising
two arms separated by an angle,
the front arm being at the blade end of the knife
said front arm of the blade guard assembly
protecting the blade in the closed position and
exposing the cutting edge of the blade in the open position
a nub
attached to the housing,
forming the pivot point of the blade guard,
a guard spring
connecting the blade guard assembly to the housing and
forcing the blade guard into the closed position,
said guard spring,
connecting the rear arm of the blade guard assembly to the housing and
forcing the blade guard into the closed position
a lock piece
locking the blade guard in the closed position
by preventing the rotation of the blade guard assembly
said lock piece
fixed to the housing at the rear end of the knife,
the front end of said lock piece is moveable sideways with respect to the housing,
said lock piece locking the blade guard in the closed position
by preventing the rotation of the blade guard assembly when the front end is on one side and
allowing the rear arm of the blade guard assembly to rotate back when the front end is on the other side
a release assembly comprising
a trigger button
fixed to the handle
unlocking said lock piece when said trigger button is pressed
said release assembly further comprising
a vertically movable release piece
having the form of an arch and
being wider at the bottom part on one side,
said wider bottom side facing the lock piece,
forcing the lock piece sideways when moving the release piece upwards, so that the blade guard can move freely
a release spring
forcing said release piece downward
a trigger assembly comprising
a trigger button
a torsion spring
forcing the trigger button into the released position whenever no pressure is applied to the button
a trigger ramp
consisting of front arm oriented vertically
and a rear arm which is basically horizontal
rotatably connected to the trigger button at the connecting point of the two arms
a button spring
connecting the rear arm of the trigger ramp to the trigger button
attempting to maintain a constant distance between the rear arm of the
trigger ramp and the trigger button
said trigger ramp being pushed upwards when the trigger button is pressed,
the front arm of the trigger ramp forcing the release piece upwards when the trigger ramp is moved upwards,
said upwards movement of the release piece
forcing the lock piece sideways when moving the release piece upwards,
so that the blade guard is no longer locked into the closed position and can move freely
a torsion spring
forcing the trigger button into the released position whenever no pressure is applied to the trigger button
a blade holder
containing the blade
mounted rotatably in the housing,
rotating about a pivot point if pressure is applied to the cutting edge of the blade
having a decoupling mechanism
allowing said lock piece to be decoupled from said release assembly which automatically relocks the blade guard as soon as it returns to the extended position
wherein said blade holder
has a decoupling extension at the rear end
which is in contact with the front arm of the trigger ramp
and moves slightly downward when said blade holder is rotated
thereby forcing the front arm of the trigger ramp out of the reach of the release piece
allowing said release piece to be forced downwards to the original position by the flat spring
allowing the lock piece to move sideways back towards the center of the cutter
automatically relocking the blade guard as soon as it returns to the extended position.

2. The hand cutter of claim 1
wherein said release spring for forcing the release piece downward is a flat spring.

3. The hand cutter of claim 1
wherein said release spring for forcing the release piece downward is a coil spring.

4. The hand cutter claim 1
wherein said release piece forming an arch has a widening step in the lower part, thus forming a wider distance between both arms of the release piece than in the upper part.

5. The hand cutter of claim 1
wherein said trigger ramp front arm contains a bump extending to the front,
said bump improving the forced rearward movement of the trigger ramp when the blade holder decoupling extension is moved downward.

6. The hand cutter of claim 1 further comprising;
a knob movably connected to one side of the housing
said knob being in a groove of the housing extending on both sides of the housing such that the inside extension prevents the rear arm of the blade guard from being rotate back further than a set position, such that the cutting depth is limited.

7. The hand cutter of claim 6 wherein said groove has preset positions in which the knob can be placed for at least one fixed predefined cutting depth.

8. The hand cutter of claim 6 wherein said knob comprises a screwing mechanism allowing the preset cutting depth to be set at any position along the groove.

9. The hand cutter of claim 1 further comprising a trigger lock disabling the function of the trigger button, by preventing movement of the trigger ramp.

10. The hand cutter of claim 9 wherein said trigger lock consists of a knob movably connected to the housing, said knob placed at the rear end of the trigger ramp in the locked position.

11. The hand cutter of claim 1 further comprising:

a loop ring end opposite of the cutting end which can be attached to a keychain or lanyard allowing convenient transportation of cutter.

* * * * *